US008157595B2

(12) United States Patent
Saraswat et al.

(10) Patent No.: US 8,157,595 B2
(45) Date of Patent: Apr. 17, 2012

(54) GROUND SHIELD FOR AN ELECTRICAL CONNECTOR

(75) Inventors: Dharmendra Saraswat, Harrisburg, PA (US); David Helster, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/835,459

(22) Filed: Jul. 13, 2010

(65) Prior Publication Data

US 2012/0015556 A1 Jan. 19, 2012

(51) Int. Cl.
*H01R 13/66* (2006.01)

(52) U.S. Cl. ..... 439/620.09; 439/607.06

(58) Field of Classification Search ..... 439/620.09, 439/620.13, 607.06, 607.07, 607.08, 607.09, 439/607.1, 607.56
See application file for complete search history.

(56) References Cited

U.S. PATENT DOCUMENTS

| | | | | |
|---|---|---|---|---|
| 5,664,968 | A * | 9/1997 | Mickievicz | 439/607.1 |
| 6,403,887 | B1 * | 6/2002 | Kebabjian et al. | 174/110 R |
| 6,431,914 | B1 * | 8/2002 | Billman | 439/607.07 |
| 6,540,558 | B1 * | 4/2003 | Paagman | 439/607.11 |
| 6,664,466 | B2 * | 12/2003 | Bailey | 174/36 |
| 6,764,349 | B2 * | 7/2004 | Provencher et al. | 439/701 |
| 6,899,566 | B2 * | 5/2005 | Kline et al. | 439/607.56 |
| 6,979,226 | B2 * | 12/2005 | Otsu et al. | 439/607.07 |
| 7,145,073 | B2 * | 12/2006 | Sexton et al. | 174/36 |
| 7,168,988 | B1 * | 1/2007 | Rothermel | 439/607.06 |
| 7,267,515 | B2 * | 9/2007 | Lappohn | 439/607.07 |
| 7,285,018 | B2 * | 10/2007 | Kenny et al. | 439/620.01 |
| 7,416,447 | B1 * | 8/2008 | Chen | 439/607.05 |
| 7,811,128 | B2 * | 10/2010 | Pan | 439/607.05 |
| 7,834,270 | B2 * | 11/2010 | Zhu et al. | 174/105 R |
| 8,007,316 | B2 * | 8/2011 | Costello | 439/607.1 |

* cited by examiner

*Primary Examiner* — Hae Moon Hyeon

(57) ABSTRACT

A ground shield is provided for an electrical connector mounted on a printed circuit. The ground shield includes a body extending from a mating interface to a mounting interface. An electrical ground path is defined through the body between the mating and mounting interfaces. The mating interface includes a mating contact configured to engage a mating connector. The mounting interface includes a mounting contact configured to engage the printed circuit. The body includes two conductive layers separated by a dielectric substance such that a capacitor is provided within the electrical ground path.

23 Claims, 5 Drawing Sheets

GROUND SHIELD FOR AN ELECTRICAL CONNECTOR

BACKGROUND OF THE INVENTION

The subject matter herein relates generally to electrical connectors, and more particularly, to electrical connectors having electrical ground paths.

Two or more electrical components are often electrically connected together to operatively connect the electrical components. Specifically, corresponding signal paths within the electrical components are electrically connected together, for example using intervening contacts and/or conductors of an intervening electrical connector, to establish signal paths between the electrical components. Similarly, corresponding electrical ground paths and/or planes within the electrical components are electrically connected together to provide one or more electrical ground paths between the electrical components. One specific example of interconnecting electrical components includes interconnecting two printed circuits (sometimes referred to as "circuit boards" or "printed circuit boards"). One of the printed circuits sometimes includes a driver circuit having an output that drives the input of a receiver circuit of the other printed circuit.

Electrical components that are electrically connected together may suffer from unintended direct current (DC) coupling therebetween. Specifically, DC may be unintentially transferred between the electrical components. For example, driver and receiver circuits on printed circuits that are interconnected may be unintentially DC coupled. Unintentional DC coupling between interconnected electrical components may be particularly troublesome for electrical components that transmit high speed (e.g., above approximately 1 gigabits per second (Gbps)) differential signals therebetween.

To block DC coupling between the electrical components, discrete capacitors are typically provided along the signal paths of one or both of the electrical components. However, only a limited amount of space is available on or near the electrical components. For example, due to the increased demand for smaller electronic packages and higher signal transmission speeds, printed circuits and other electrical components may not have room for conventional discrete DC blocking capacitors. Adding discrete capacitors to the electrical components to block unintended DC coupling may therefore increase a size of the electrical components. In addition or alternatively to the increased size, the addition of discrete capacitors to the electrical components may reduce a density of contacts, conductors, circuits, and/or the like of the electrical components, which may negatively impact signal transmission rates between the electrical components. Moreover, parasitic inductance, capacitance, resistance, and/or the like of the discrete capacitors within the electrical components may also reduce signal transmission speeds between electrical components that transmit high speed differential signals therebetween.

BRIEF DESCRIPTION OF THE INVENTION

In one embodiment, a ground shield is provided for an electrical connector mounted on a printed circuit. The ground shield includes a body extending from a mating interface to a mounting interface. An electrical ground path is defined through the body between the mating and mounting interfaces. The mating interface includes a mating contact configured to engage a mating connector. The mounting interface includes a mounting contact configured to engage the printed circuit. The body includes two conductive layers separated by a dielectric substance such that a capacitor is provided within the electrical ground path.

In another embodiment, a contact module is provided for an electrical connector. The contact module includes a module body having a mating edge and a mounting edge, and a lead frame held by the module body. The lead frame includes at least one electrical lead extending from a mating contact to a mounting contact. The mating contact extends outwardly from the mating edge of the module body. The mounting contact extends outwardly from the mounting edge of the module body. A ground shield is mounted on the module body. The ground shield includes a capacitor.

In another embodiment, an electrical connector is provided for interconnecting first and second electrical components. The electrical connector includes a housing and a signal conductor held by the housing. The signal conductor defines a signal path through the housing. A ground conductor is held by the housing. The ground conductor defines an electrical ground path through the housing. A capacitor is provided within the ground path.

DETAILED DESCRIPTION OF THE INVENTION

Figure 1:
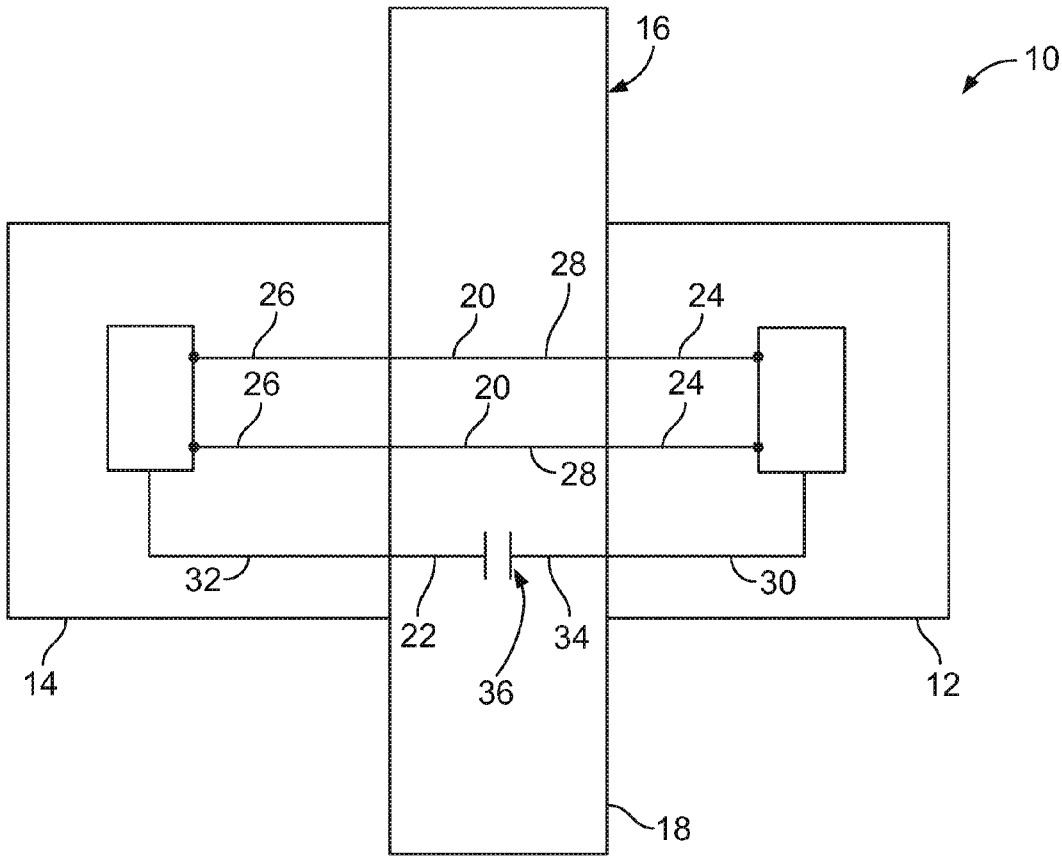
FIG. 1 is a schematic diagram of an exemplary embodiment of an electrical system.

FIG. 1 is a schematic diagram of an exemplary embodiment of an electrical system 10. The system 10 includes two electrical components 12 and 14 and an electrical connector 16. The electrical connector 16 provides an electrical connection between the electrical components 12 and 14. Specifically, the electrical connector 16 includes a housing 18 that holds one or more signal conductors 20 and one or more ground conductors 22. Each signal conductor 20 is electrically connected to respective electrical contacts 24 and 26 of the electrical components 12 and 14. Each of the electrical contacts 24 and 26 defines at least a portion of a signal path within the respective electrical component 12 and 14. Each signal conductor 20 of the electrical connector 16 defines a signal path 28 between the electrical components 12 and 14. Specifically, each signal conductor 20 defines a signal path 28 from the electrical contact 24 of the electrical component 12, through the housing 18 of the electrical connector 16, and to the electrical contact 26 of the electrical component 14, and/or vice versa. Each ground conductor 22 is electrically connected to an electrical ground contact and/or plane 30 and 32 of each of the electrical components 12 and 14, respectively. Each of the ground contacts and/or planes 30 and 32 defines at least a portion of an electrical ground path within the respective electrical component 12 and 14. Each ground conductor 22 of the electrical connector 16 defines an electrical ground path 34 through the housing 18 and between the ground contacts and/or planes 30 and 32 of the electrical components 12 and 14, respectively.

In accordance with embodiments of the present invention, the electrical connector 16 includes a capacitor 36 provided within the electrical ground path 34. Specifically, the capacitor 36 is operatively connected to the ground conductor 22 of the electrical connector 16 at any location on the ground conductor 22. The capacitor 36 is configured to reduce or eliminate direct current (DC) coupling between the electrical components 12 and 14. The capacitor 36 may be various types of capacitors having various overall constructions. Examples of the capacitor 36 include, but are not limited to, a parallel plate capacitor, a fixed capacitor, a variable capacitor, a gimmick capacitor, a trimmer capacitor, an electrolytic capacitor, a printed circuit board capacitor, an integrated circuit capacitor, a vacuum capacitor, and/or the like.

In some embodiments, the capacitor 36 is at least partially defined by the ground conductor(s) 22. In other embodiments, the capacitor 36 is a capacitive structure embedded within and connected in series with the ground conductor 22. A capacitive structure generally includes at least two conductive layers separated by at least one dielectric layer. As used herein, the term "operatively connected to" is intended to encompass both embodiments wherein one or more conductive layers of the capacitor 36 is at least partially defined by the ground conductor(s) 22 and embodiments wherein the conductive layers of the capacitor 36 are physically separate structures that are embedded within and electrically connected in series with the ground conductor(s) 22. Although the electrical connector 16 in FIG. 1 includes only a single capacitor 36 within the ground path 34, any number of capacitors 36 may be provided at any location within the ground path 34 of the electrical connector 16.

In the exemplary embodiment, the electrical connector 16 includes two signal conductors 20 arranged to carry a differential pair of signals. In addition or alternatively to the differential pair of signal conductors 20, the electrical connector 16 may include one or more signal conductors 20 that is not arranged in a differential pair. The electrical connector 16 may include any number of the signal conductors 20, any number of which may or may not be arranged in differential pairs. Although only one is shown, the electrical connector 16 may include any number of the ground conductors 22.

Each of the electrical components 12 and 14 may be any type of electrical component, such as, but not limited to, a computer, a processor, a memory, a printed circuit, a signal driver, a signal receiver, an electrical power supply, an electrical load, an integrated circuit, a video device and/or component, an audio device and/or component, a communications device and/or component, a hand held device, a personal digital assistant (PDA), a high-speed (e.g., data rates of at least 1 Gbps) electrical device, and/or the like. Each of the electrical components 12 and 14 may be referred to herein as a "first electrical component" and/or a "second electrical component".

The subject matter described and/or illustrated herein is not limited to any particular type of electrical connector. Rather, one or more capacitors may be provided within the ground path of any type of electrical connector that interconnects any types of electrical components together. For example, the electrical connector 16 may be, but is not limited to, an electrical connector that interconnects two printed circuits together (e.g., the connector system 100 described below with reference to FIGS. 2-6), a transceiver assembly, an electrical plug and/or port, one or both halves of a two or more piece separable connector, a cable, and/or the like.

Figure 2:
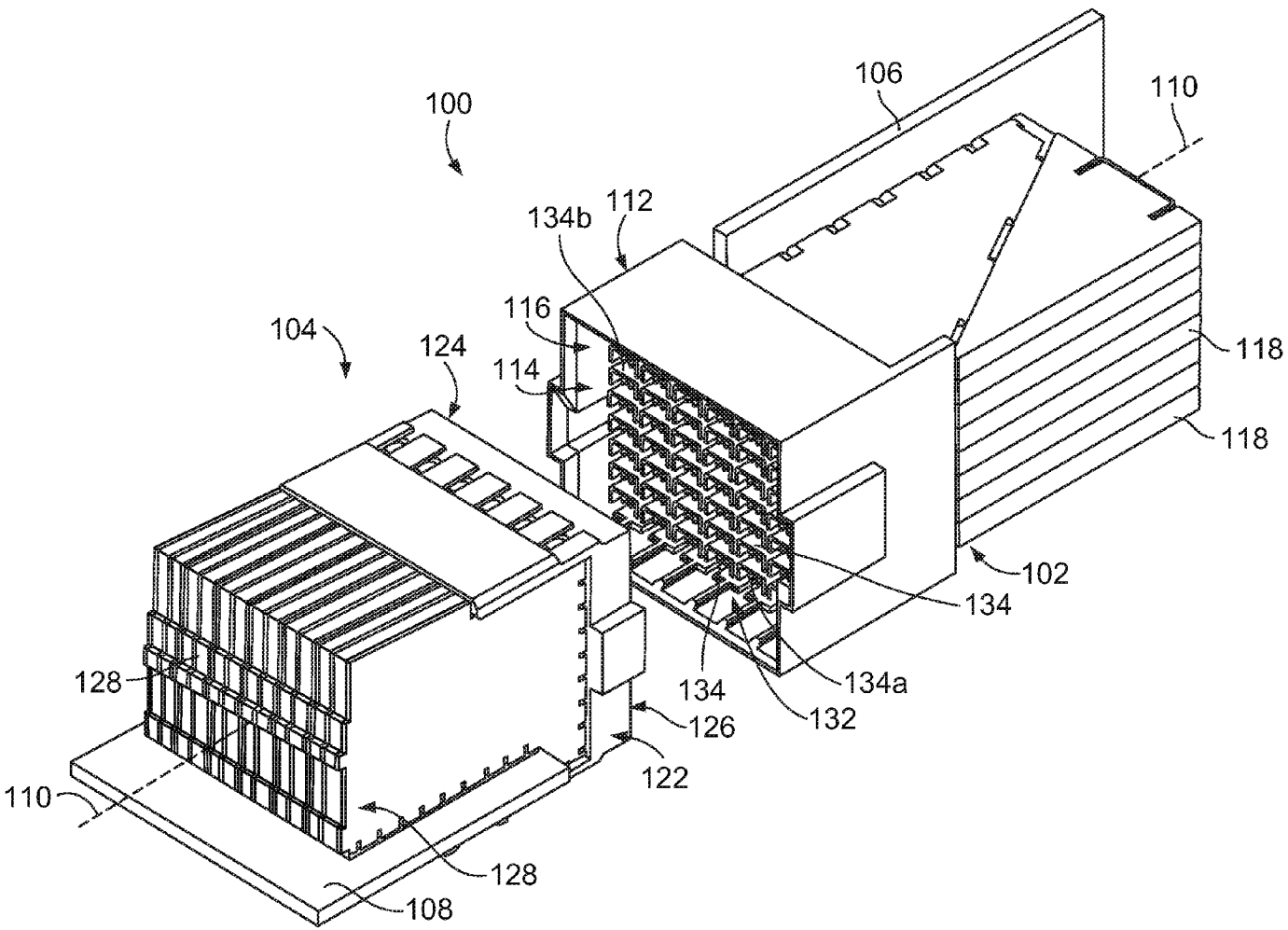
FIG. 2 is a perspective view of an exemplary embodiment of a connector system illustrating an exemplary embodiment of a receptacle assembly and an exemplary embodiment of a header assembly in unmated positions.

FIG. 2 is a perspective view of an exemplary embodiment of an orthogonal connector system 100 illustrating two connector assemblies 102 and 104 that may be directly mated together. The connector assemblies 102 and 104 are each electrically connected to a respective printed circuit 106 and 108. The connector assemblies 102 and 104 are utilized to electrically connect the printed circuits 106 and 108 to one another along a separable mating interface. The printed circuits 106 and 108 are orthogonal to one another and the connector assemblies 102 and 104 are orthogonal to one another. For example, the connector assemblies 102 and 104 are turned 90° relative to each other. A mating axis 110 extends through the connector assemblies 102 and 104. The connector assemblies 102 and 104 are mated together in a direction parallel to and along the mating axis 110. In the exemplary embodiment, both the printed circuits 106 and 108 extend approximately parallel to the mating axis 110.

In the exemplary embodiment, the connector assembly 102 constitutes a header assembly, and will be referred to hereinbelow as "header assembly 102". The connector assembly 104 constitutes a receptacle assembly, and will be referred to hereinbelow as "receptacle assembly 104". The header assembly 102 and the receptacle assembly 104 may each be referred to herein as an "electrical connector".

The header assembly 102 includes a housing 112 having a mating face 114 at an end 116 of the housing 112. A plurality of contact modules 118 are held by the housing 112. The contact modules 118 are electrically connected to the printed circuit 106. The mating face 114 is optionally oriented approximately perpendicular to the printed circuit 106 and the mating axis 110. Similar to the header assembly 102, the receptacle assembly 104 includes a housing 122 having a mating face 124 at an end 126 of the housing 122. A plurality of contact modules 128 are held by the housing 122. The contact modules 128 are electrically connected to the printed circuit 108. The mating face 124 is optionally oriented approximately perpendicular to the printed circuit 108 and the mating axis 110.

The housing 112 of the header assembly 102 includes a chamber 132 that receives a portion of the housing 122 of the receptacle assembly 104 therein. An array of mating contacts 134 is arranged within the chamber 132 for mating with corresponding mating contacts 136 (FIGS. 3 and 4) of the receptacle assembly 104. The mating contacts 134 extend from corresponding contact modules 118 into the chamber 132 when the contact modules 118 are held by the housing 112. The mating contacts 134 are electrically connected to the printed circuit 106 via corresponding electrical leads (not shown) of the contact modules 118. The mating contacts 134 include signal contacts **134*a* and ground contacts 134*b***.

Figure 3:
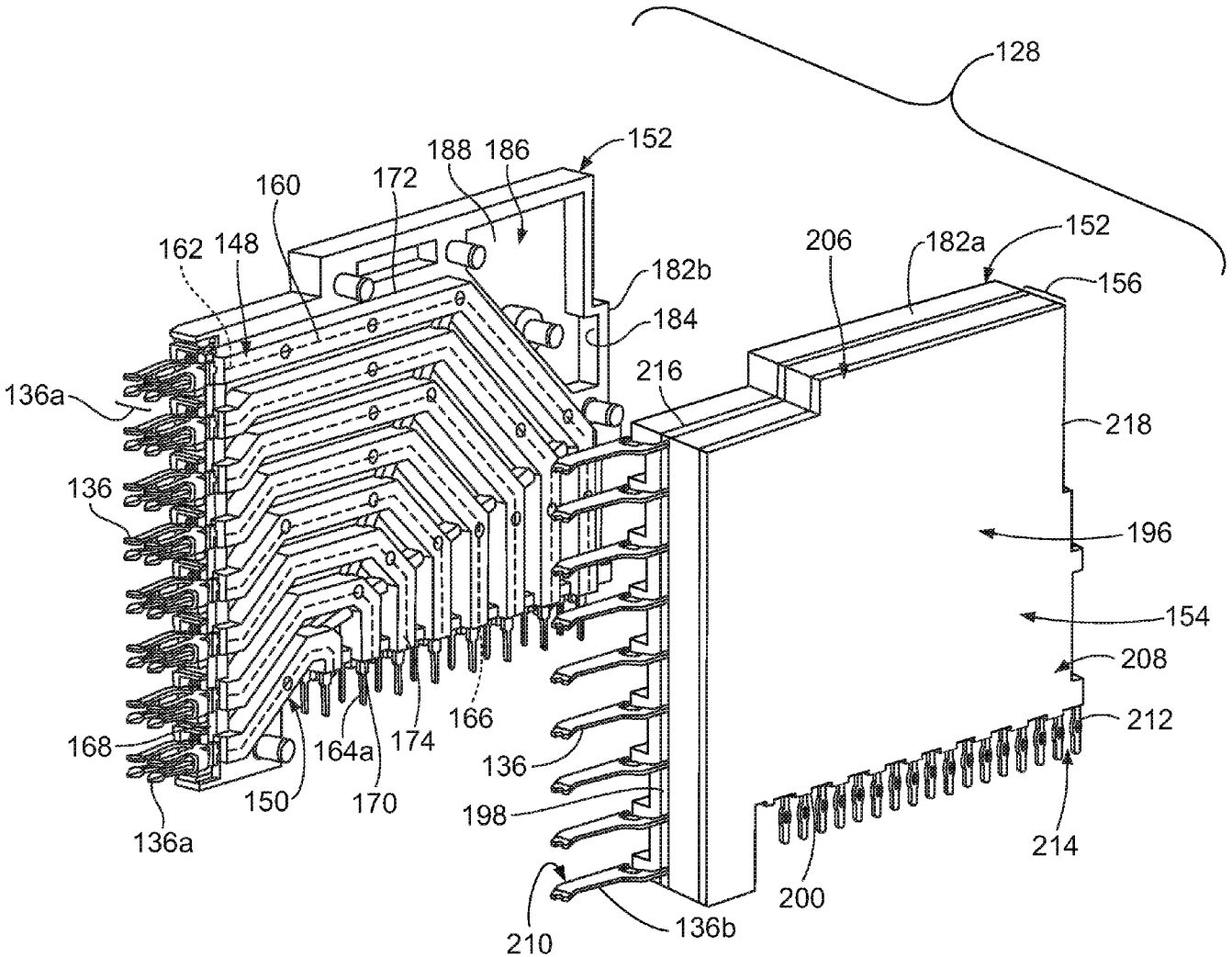
FIG. 3 is a partially exploded perspective view of an exemplary embodiment of a contact module of the receptacle assembly shown in FIG. 2.

FIG. 3 is a partially exploded perspective view an exemplary embodiment of a contact module 128 of the receptacle assembly 104 (FIG. 2). In the exemplary embodiment, the contact module 128 includes a lead frame 148 (shown with phantom lines), a body 150, an optional electrically conductive shell 152, a ground shield 154, and the mating contacts 136. The mating contacts 136 include signal contacts **136*a* and ground contacts 136*b*. The body 150 may be referred to herein as a "module body" and/or as a "housing". The signal contacts 136*a* may be referred to herein as "signal conductors". The ground contacts 136*b*** may be referred to herein as "ground conductors".

The body 150 holds the lead frame 148 and the signal contacts **136*a*. The shell 152 is mounted on the body 150 such that the shell 152 at least partially surrounds the body 150**.

The ground shield 154 includes the ground contacts 136*b* and is mounted on the shell 152. The ground shield 154 can be considered to be mounted indirectly on the body 150 because the ground shield 154 is mounted on the shell 152, which is mounted on the body 150 between the body 150 and the ground shield 154. In some alternative embodiments, the contact module 128 does not include the shell 152 and the ground shield 154 is mounted directly on the body 150. Although shown as including a single ground shield 154 (mounted on a shell section 182*a* of the shell 152), the contact module 128 may alternatively include more than one ground shield 154. For example, the contact module 128 optionally includes another ground shield (not shown) mounted on a shell section 182*b* of the shell 152.

As will be described below, in the exemplary embodiment, the ground shield 154 includes a capacitor 156 that is defined by a body 196 of the ground shield 154. The body 196 has a forward mating edge 198 and a bottom mounting edge 200 that is generally perpendicular to the mating edge 198. The ground shield body 196 has an inner side 206 and an outer side 208. The inner side 206 generally faces the shell 152 and the outer side 208 generally faces away from the shell 152. The body 196 of the ground shield 154 may be referred to herein as a "shield body" and/or as a "ground conductor".

In the exemplary embodiment, the ground shield 154 includes the ground contacts 136*b*, which extend from the mating edge 198. The ground contacts 136*b* define a mating interface 210 of the body 196 of the ground shield 154. Each ground contact 136*b* is configured for mating with the corresponding ground contact 134*b* (FIG. 2) of the header assembly 102 (FIG. 2). The ground shield 154 includes shield tails 212 that extend from the mounting edge 200 for electrically connecting the body 196 of the ground shield 154 to the printed circuit 108 (FIG. 2). The shield tails 212 define a mounting interface 214 of the body 196 of the ground shield 154.

The ground shield 154 provides an electrical ground path through the receptacle assembly 104 (FIG. 2), including through the housing 122 (FIG. 2) of the receptacle assembly 104 and the corresponding contact module 128. Specifically, the electrical ground path is defined through the body 196 of the ground shield 154 between the mating interface 210 and the mounting interface 214. When the receptacle assembly 104 is mounted on the printed circuit 108 and mated with the header assembly 102, the ground shield body 196 defines a portion of an electrical ground path between the printed circuits 106 and 108 (FIG. 2). The other portion of the electrical ground path between the printed circuit 106 and 108 is provided through the header assembly 102.

Figure 4:
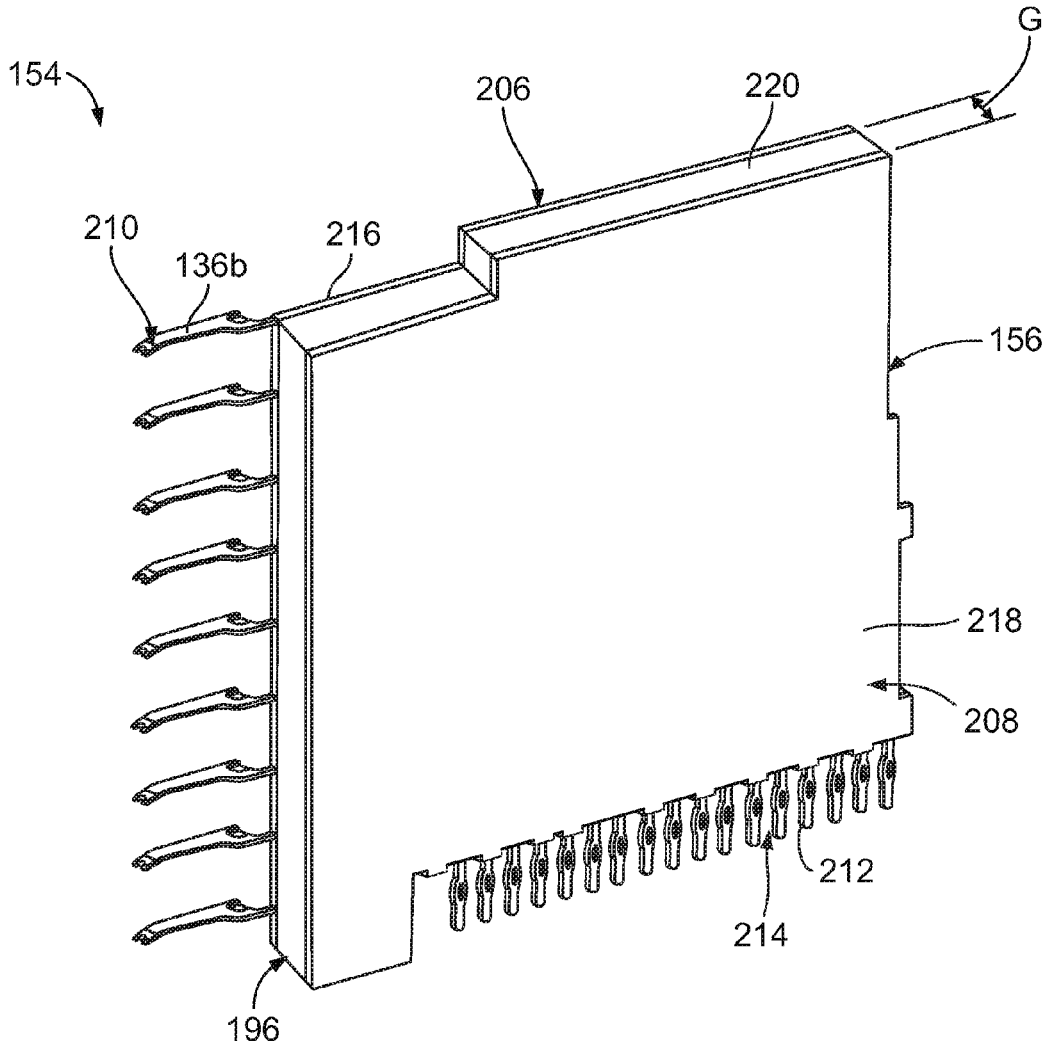
FIG. 4 is a perspective view of an exemplary embodiment of a ground shield of the contact module shown in FIG. 3.

FIG. 4 is a perspective view of an exemplary embodiment of the ground shield 154. The body 196 of the ground shield 154 includes two electrically conductive plates 216 and 218 and a dielectric layer 220 extending between the plates 216 and 218. The plate 216 defines the inner side 206 of the ground shield body 196 and the plate 218 defines the outer side 208 of the body 196. As best seen in FIG. 3, the ground shield 154 is mounted on the body 150 of the contact module 128 such that the plate 216 extends over at least a portion of a side 174 of the contact module body 150. Referring again to FIG. 4, optionally, one of the plates 216 includes the ground contacts 136*b*, and thus the mating interface 210, while the other plate 218 includes the shield tails 212, and thus the mounting interface 214, or vice versa. Alternatively, one of the plates 216 or 218 includes both the ground contacts 136*b* and the shield tails 212, so long as the electrical ground path through the body 196 extends through both plates 216 and 218. Each of the plates 216 and 218 may be referred to herein as a "first plate", a "second plate", and/or a "conductive layer". The dielectric layer 220 may be referred to herein as a "dielectric substance".

The dielectric layer 220 and the plates 216 and 218 of the body 196 of the ground shield 154 define the capacitor 156. Specifically, the plates 216 and 218 are spaced apart from each other by a gap G. The dielectric layer 220 extends within the gap G between the plates 216 and 218. In other words, the dielectric layer 220 and the plates 216 and 218 are arranged in a stack with the dielectric layer 220 extending between the plates 216 and 218 to space the plates 216 and 218 apart. The spaced-apart plates 216 and 218 and the dielectric layer 220 thereby define a capacitive structure. Accordingly, the body 196 of the ground shield 154 defines the capacitor 156. Because the ground shield 154 defines a portion of an electrical ground path, the capacitor 156 is provided within the electrical ground path.

Various parameters of the capacitor 156 may be selected to provide a predetermined capacitance within the electrical ground path of the ground shield 154. Optionally, the capacitor 156 is utilized to facilitate reducing and/or eliminating DC coupling between the printed circuits 106 and 108 (FIG. 2). The capacitance of the capacitor 156 may be selected to provide a predetermined amount of DC coupling reduction and/or elimination between the printed circuits 106 and 108. Examples of parameters of the capacitor 156 that may be selected to provide the predetermined capacitance include, but are not limited to, the materials used to fabricate the dielectric layer 220 and the plates 216 and 218, electrical conductivity of the plates 216 and 218, a dielectric constant of the dielectric layer 220, the distance between the plates 216 and 218 (e.g., the amount of the gap G), the thickness of the plates 216 and 218, the surface area of the plates 216 and 218, an area of the amount the plates 216 and 218 overlap each other, and/or the like.

The plates 216 and 218 may each be fabricated from any suitable types and structures of electrically conductive materials, such as, but not limited to, metals, metallic substances, non-metallic electrically conductive materials, foils, papers, and/or the like. The dielectric layer 220 may be fabricated from any suitable types and structures of electrically insulating materials, such as, but not limited to, ceramics, wire insulation materials, glass, papers, oil-impregnated papers, polycarbonate, polyester, polystyrene, polypropylene, polysulfone, polytetra-fluoroethylene (PTFE; e.g., Teflon®), polyethylene terephthalate (PET), polyamide, polyimide (e.g., Kapton®), titanate, barium titanate, aluminum oxide mica, lithium ion, tantalum oxide, an electrolyte layer and activated carbon, castor oil, a vacuum, air (with a suitable dielectric support to hold the plates 216 and 218 spaced apart), an electrically insulative substrate, the substrate of a printed circuit, and/or the like.

In the exemplary embodiment, the plates 216 and 218 are arranged approximately parallel to each other such that the body 196 of the ground shield 154 defines a parallel plate capacitor. Alternatively, the plates 216 and 218 are arranged non-parallel to each other. Moreover, although shown as being approximately planar, some or all surfaces of the plates 216 and 218 may alternatively be non-planar. In alternative to the parallel plate capacitor, the capacitor 156 may be any type of capacitor having any type of overall construction, a dielectric of any materials and any construction, and conductors of any materials and any construction, whether the capacitor 156 is defined by the ground shield body 196 or is embedded within and electrically connected in series with the body 196. Examples of other types of the capacitor 156 besides a parallel plate capacitor include, but are not limited to, a fixed capacitor, a variable capacitor, a gimmick capacitor, a trimmer capacitor, an electrolytic capacitor, a printed circuit board capacitor, an integrated circuit capacitor, a vacuum capacitor, and/or the like.

As described above, in the exemplary embodiment the body 196 of the ground shield 154 defines the capacitor 156. Alternatively, the capacitor 156 is a physically separate structure from the body 196 of the ground shield 154 that is embedded within and electrically connected in series with the body 196. For example, in some alternative embodiments the ground shield body 196 includes only one of the plates 216 or 218 and the capacitor 156 is embedded within and electrically connected in series with the single plate.

In the exemplary embodiment, each ground contact 136*b* includes a single beam that is configured to mate with the blade of the corresponding ground contact 134*b* (FIG. 2). Other types of contacts may be used in alternative embodiments for mating with the blade of the ground contact 134*b* or for mating with other types of ground contacts of the header assembly 102. As shown herein, the shield tails 212 are eye-of-the-needle type contacts that fit into vias (not shown) of the printed circuit 108. Other types of contacts may be used in alternative embodiments for electrically connecting the ground shield body 196 to the printed circuit 108, such as, but not limited to, surface mount contacts, solder tails, and/or the like.

Figure 5:
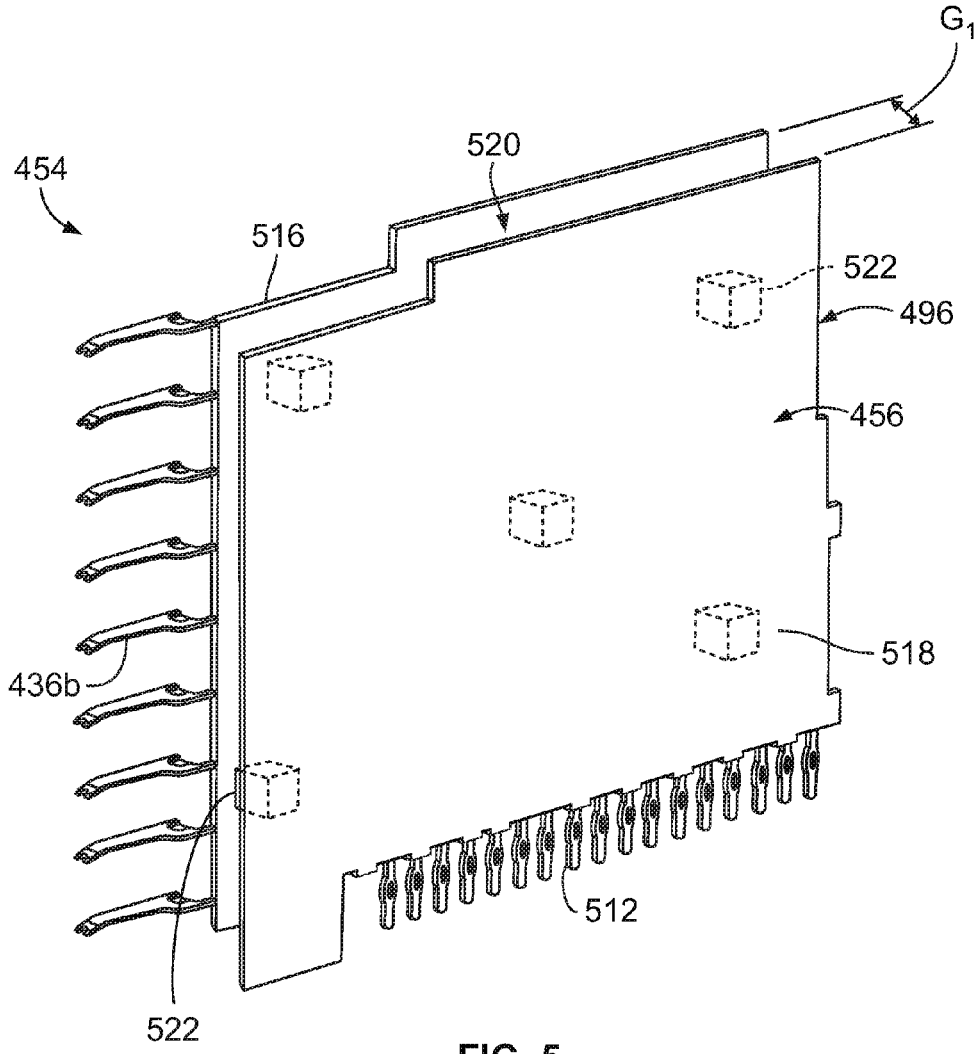
FIG. 5 is a perspective view of an exemplary alternative embodiment of a ground shield of the contact module shown in FIG. 3.

FIG. 5 is a perspective view of an exemplary alternative embodiment of a ground shield 454. The ground shield 454 has a body 496 that includes two electrically conductive plates 516 and 518. The plates 516 and 518 are spaced apart from each other by a gap $G_1$. One or more dielectric supports 522 extend between the plates 516 and 518 to hold the plates 516 and 518 apart from each other by the gap $G_1$. Air 520 extends within the gap $G_1$ between the plates 516 and 518. The spaced-apart plates 516 and 518 and the air 520 extending within the gap $G_1$ therebetween define a capacitive structure. Accordingly, the body 496 of the ground shield 454 defines a capacitor 456. Because the ground shield 454 defines a portion of an electrical ground path, the capacitor 456 is provided within the electrical ground path.

Optionally, the plate 516 includes ground contacts 436*b*, while the other plate 518 includes shield tails 512, or vice versa. Alternatively, one of the plates 516 or 518 includes both the ground contacts 436*b* and the shield tails 512, so long as the electrical ground path through the body 496 extends through both plates 516 and 518. The dielectric supports 522 may have any suitable arrangement, configuration, and/or the like for spacing the plates 516 and 518 apart. Each of the plates 516 and 518 may be referred to herein as a "first plate", a "second plate", and/or a "conductive layer". The air 520 extending within the gap $G_1$ between the plates 516 and 518 may be referred to herein as a "dielectric substance".

Referring again to FIG. 3, the lead frame 148 includes a plurality of metal conductors, or leads, 160. The signal contacts 136*a* extend outwardly from ends 162 of the conductors 160. Signal mounting contacts 164*a* extend outwardly from ends 166 of the conductors 160 that are opposite the ends 162. The signal mounting contacts 164*a* are configured to be mounted on the printed circuit 108 (FIG. 2). The body 150 of the contact module 128 surrounds the conductors 160 of the lead frame 148 and has a mating edge 168 and a mounting edge 170. The signal contacts 136*a* extend outwardly from the mating edge 168, while the signal mounting contacts 164*a* extend outwardly from the mounting edge 170. In the exemplary embodiment, the contact module 128 is a right-angle contact module wherein the mating edge 168 is oriented generally perpendicular with respect to the mounting edge 170. The conductors 160 may be referred to herein as "signal conductors".

Optionally, the signal contacts 136*a* are arranged in differential pairs 136A. As can be seen in FIG. 3, the ground contacts 136*b* are interspersed between adjacent differential pairs 136A of the signal contacts 136*a*. In the exemplary embodiment, each signal mounting contact 164*a* constitutes an eye of the needle type contact that is configured to be received within a via (not shown) of the printed circuit 108. Other types of contacts may be used in alternative embodiments for mounting to the printed circuit 108, such as, but not limited to, surface mount contacts, solder tails, and/or the like. In the exemplary embodiment, each of the signal contacts 136*a* constitutes a tuning fork style of contact that is configured to receive and mate with the blade of the corresponding signal contact 134*a* (FIG. 2). Other types of contacts may be used in alternative embodiments for mating with the blade of the signal contact 134*a* or for mating with other types of signal contacts of the header assembly 102 (FIG. 2).

In the exemplary embodiment, the optional shell 152 includes two shell sections 182*a* and 182*b* that are secured together to form the shell 152. Optionally, the shell sections 182*a* and 182*b* are generally mirrored halves of the shell 152. Each shell section 182*a* and 182*b* includes a recess 184 (only one of which is visible in FIG. 3) that receives a portion of the body 150 of the contact module 128 therein. The recesses 184 cooperate to define an interior cavity 186 of the shell 152 when the shell sections 182*a* and 182*b* are secured together. The interior cavity 186 is defined between side walls 188 of the shell sections 182*a* and 182*b*. When the shell sections 182*a* and 182*b* are secured together, the body 150 is held within the interior cavity 186 between the side walls 188 such that the side walls 188 of the shell 152 extend over the sides 172 and 174 of the body 150.

The shell section 182*a* optionally includes mounting features (not shown) for holding the ground shield 154 thereon. For example, the mounting features may be represented by openings (not shown) on the shell section 182*a* that receive complementary mounting tabs (not shown) of the ground shield 154. The mounting tabs may be received within the openings with an interference fit to hold the ground shield 154 on the shell 152. Other types of mounting features may be used in alternative embodiments, such as a fastener, a latch, an adhesive, and/or the like. Any number of mounting features may be used. More than one type of mounting features may be provided.

Figure 6:
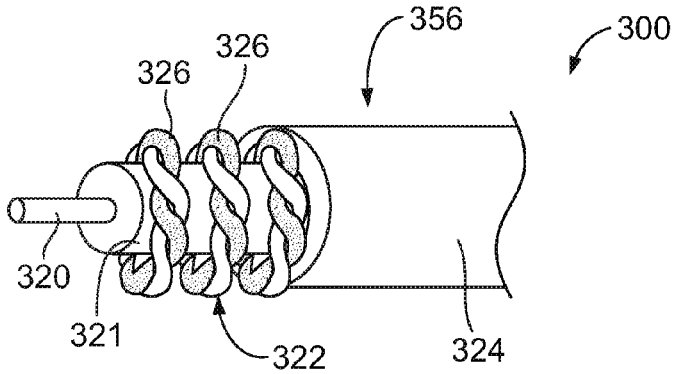
FIG. 6 is a partially broken-away perspective view of a portion of an exemplary embodiment of an electrical cable.

FIG. 6 is a partially broken-away perspective view of a portion of an exemplary embodiment of an electrical cable 300. The cable 300 may be used to provide an electrical connection between two electrical components. The electrical cable 300 includes a central signal conductor 320, an electrically insulating layer 321 surrounding the signal conductor 320, a ground conductor 322 surrounding the insulating layer 321, and an outer sheath 324 surrounding the ground conductor 322. The cable 300 can be considered an electrical connector wherein the outer sheath 324 is a housing that holds the signal conductor 320, the insulating layer 321, and the ground conductor 322. The signal conductor 320 defines a signal path between the electrical components. The ground conductor 322 defines an electrical ground path between the electrical components.

The cable 300 includes a capacitor 356 provided within the electrical ground path. Optionally, the capacitor 356 is configured to reduce or eliminate direct current (DC) coupling between the electrical components. In the exemplary embodiment, the capacitor 356 is defined by the ground conductor 322. Specifically, the ground conductor 322 is formed from two insulated electrical wires 326 that are twisted together and wrapped helically around the insulating layer 321. Accordingly, the capacitor 356 is a gimmick capacitor. Alternatively, the capacitor 356 is a physically separate structure from the ground conductor 322 that is embedded within and electrically connected in series with the ground conductor 322. The capacitor 356 may be any type of capacitor having any type of overall construction, a dielectric of any materials and any construction, and conductors of any materials and any construction. Examples of the capacitor 356 besides a gimmick capacitor include, but are not limited to, a parallel plate capacitor, a fixed capacitor, a variable capacitor, a gimmick capacitor, a trimmer capacitor, an electrolytic capacitor, a printed circuit board capacitor, an integrated circuit capacitor, a vacuum capacitor, and/or the like.

The cable 300 is not limited to the illustrated coaxial cable. Rather, the cable 300 may be any other type of cable (having any number of signal conductors 320 and ground conductors 322) having one or more capacitors provided within the electrical ground path of the cable 300.

As used herein, the term "printed circuit" is intended to mean any electric circuit in which the conducting connections have been printed or otherwise deposited in predetermined patterns on an electrically insulating substrate. Substrates of the printed circuits 106 and 108 may each be a flexible substrate or a rigid substrate. The substrates may be fabricated from and/or include any material(s), such as, but not limited to, ceramic, epoxy-glass, polyimide (such as, but not limited to, Kapton® and/or the like), organic material, plastic, polymer, and/or the like. In some embodiments, one or both of the substrates is a rigid substrate fabricated from epoxy-glass, such that the corresponding printed circuit 106 and/or 108 is what is sometimes referred to as a "circuit board" or a "printed circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A ground shield for an electrical connector mounted on a printed circuit, said ground shield comprising:

a body extending from a mating interface to a mounting interface, an electrical ground path being defined through the body between the mating and mounting interfaces, the mating interface comprising a mating contact configured to engage a mating connector, the mounting interface comprising a mounting contact configured to engage the printed circuit, wherein the body comprises two conductive layers separated by a dielectric substance such that a capacitor is provided within the electrical ground path.

2. The ground shield according to claim 1, wherein the conductive layers of the body comprise electrically conductive plates that are spaced apart from each other by a gap, the dielectric substance extending within the gap between the two plates.

3. The ground shield according to claim 1, wherein the capacitor is a parallel plate capacitor.

4. The ground shield according to claim 1, wherein the conductive layers of the body comprise electrically conductive plates arranged approximately parallel to each other and spaced apart from each other by a gap, the dielectric substance extending within the gap between the two plates.

5. The ground shield according to claim 1, wherein the conductive layers of the body comprise first and second electrically conductive plates, the dielectric substance comprising a dielectric layer, the dielectric layer and the first and second plates being arranged in a stack with the dielectric layer extending between the first and second plates.

6. The ground shield according to claim 1, wherein the conductive layers of the body comprise two electrically conductive plates that are spaced apart from each other by a gap, the dielectric substance extending within the gap between the two plates, wherein the dielectric substance comprises air.

7. The ground shield according to claim 1, wherein the conductive layers of the body comprise first and second plates that are spaced apart from each other by a gap, the dielectric substance extending within the gap between the first and second plates, wherein the first plate comprises the mating interface and the second plate comprises the mounting interface.

8. The ground shield according to claim 1, wherein the conductive layers of the body comprise at least one plate having an edge, and wherein the mating contact or the mounting contact extends outwardly from the edge or defines a portion of the edge.

9. A contact module for an electrical connector, said contact module comprising:

a module body having a mating edge and a mounting edge;

a lead frame held by the module body, the lead frame comprising at least one electrical lead extending from a mating contact to a mounting contact, the mating contact extending outwardly from the mating edge of the module body, the mounting contact extending outwardly from the mounting edge of the module body; and a ground shield mounted on the module body, the ground shield comprising a capacitor.

10. The contact module according to claim 9, wherein the ground shield comprises a shield body having two electrically conductive plates that are spaced apart from each other by a gap and a dielectric substance extending within the gap between the two plates, the plates and the dielectric substance of the shield body defining the capacitor.

11. The contact module according to claim 9, wherein the ground shield comprises a shield body extending from a mating interface to a mounting interface, an electrical ground path being defined through the shield body between the mating and mounting interfaces, the mating interface being configured to engage a mating connector, the mounting interface being configured to be engage a printed circuit on which the electrical connector is configured to be mounted, wherein the capacitor is provided within the electrical ground path.

12. The contact module according to claim 9, wherein the capacitor is a parallel plate capacitor.

13. The contact module according to claim 9, wherein the ground shield comprises a shield body having two electrically conductive plates arranged approximately parallel to each other and spaced apart from each other by a gap, a dielectric substance extending within the gap between the two plates, the plates and the dielectric substance of the shield body defining the capacitor.

14. The contact module according to claim 9, wherein the ground shield comprises a shield body having first and second electrically conductive plates and a dielectric layer, the dielectric layer and the first and second plates being arranged in a stack with the dielectric layer extending between the first and second plates.

15. The contact module according to claim 9, wherein the ground shield comprises a shield body having two plates that are spaced apart from each other by a gap and a dielectric substance extending within the gap between the two plates, the plates and the dielectric substance of the shield body defining the capacitor, wherein the dielectric substance comprises air.

16. The contact module according to claim 9, wherein the ground shield comprises a shield body having first and second plates that are spaced apart from each other by a gap and a dielectric substance extending within the gap between the two plates, the plates and the dielectric substance of the shield body defining the capacitor, wherein the first plate comprises a mating interface configured to engage a mating connector, and the second plate comprises a mounting interface configured to be engage a printed circuit on which the electrical connector is configured to be mounted.

17. The contact module according to claim 9, wherein the module body comprises a side extending between the mating and mounting edges, the ground shield comprising an approximately planar plate mounted on the side of the module body such that the plate extends over at least a portion of the side of the module body.

18. The contact module according to claim 9, wherein the ground shield comprises a shield body having two electrically conductive plates that are spaced apart from each other by a gap and a dielectric substance extending within the gap between the two plates, the plates and the dielectric substance of the shield body defining the capacitor, and wherein the module body does not extend within the gap between the two plates.

19. The contact module according to claim 9, wherein the ground shield comprises two electrically conductive plates that are spaced apart from each other by a gap and a dielectric substance extending within the gap, the plates and the dielectric substance of defining the capacitor, the gap being defined between interior sides of the plates, the plates comprising exterior sides that are opposite the interior sides, wherein the ground shield is mounted on the module body such that the exterior side of one of the plates faces the module body.

20. An electrical connector for interconnecting first and second electrical components, said electrical connector comprising:

a housing;

a signal conductor held by the housing, the signal conductor defining a signal path through the housing; and a ground conductor held by the housing, the ground conductor defining an electrical ground path through the housing, wherein a capacitor is provided within the ground path.

21. The electrical connector according to claim 20, wherein the ground conductor comprises a ground shield configured to shield the signal conductor.

22. The electrical connector according to claim 20, further comprising a contact module holding the signal conductor, the contact module comprising a dielectric body, the ground conductor comprising a ground shield mounted on a side of the dielectric body, the contact module being held by the housing.

23. The electrical connector according to claim 20, further comprising a contact module holding the signal conductor, the contact module being held by the housing, the contact module comprising a dielectric body, the ground conductor comprising a ground shield that includes two electrically conductive plates that are spaced apart from each other by a gap and a dielectric substance extending within the gap, the plates and the dielectric substance of defining the capacitor, the gap being defined between interior sides of the plates, the plates comprising exterior sides that are opposite the interior sides, wherein the ground shield is mounted on the side of the dielectric body such that the exterior side of one of the plates faces the side of the dielectric body.

* * * * *